United States Patent [19]

Chavis

[11] 3,946,958

[45] Mar. 30, 1976

[54] ROTATABLE YARN WINDING SPINDLE

[76] Inventor: Julian B. Chavis, Box 939, Gastonia, N.C. 28052

[22] Filed: June 19, 1974

[21] Appl. No.: 480,757

Related U.S. Application Data

[63] Continuation of Ser. No. 285,103, Aug. 30, 1972, abandoned.

[52] U.S. Cl. ..... 242/46.3

[51] Int. Cl.[2] ..... B65H 75/30

[58] Field of Search ..... 242/46.3, 46.2, 46.21, 242/46.4, 46.5, 46.6, 130.1

[56] References Cited

UNITED STATES PATENTS

| | | | |
|---|---|---|---|
| 535,617 | 3/1895 | Foster | 242/130.1 |
| 1,212,600 | 1/1917 | Altemus | 242/46.3 |
| 1,259,448 | 3/1918 | Reynolds | 242/46.3 X |
| 2,704,638 | 3/1955 | Eheim | 242/46.3 |
| 2,746,689 | 5/1956 | Berkepeis | 242/46.3 |

*Primary Examiner*—Stanley N. Gilreath
*Attorney, Agent, or Firm*—Edwin E. Greigg

[57] ABSTRACT

The invention relates to a rotatable yarn winding spindle provided with a cone holder, the latter including spring finger elements adapted to be moved into and out of engagement with the inner wall of the cone holder upon flexure of the spring finger elements whereby the cone may be positioned upon or removed from the cone holder.

5 Claims, 3 Drawing Figures

ROTATABLE YARN WINDING SPINDLE

This is a Continuation, of application Ser. No. 285,103, filed Aug. 30, 1972 now abandoned.

The present invention is an improvement in cone holder for high yoke assemblies of high speed winders for the textile industry. In the past these devices have comprised solid cone holders which have required some external means for releasing the wound cone from the holder and for removing the wound cone. Further, these previous devices have required some external means of positively retaining the rapidly spinning cone on the holder, thereby preventing self-ejection before it is desired to be removed. In order to combat the centrifugal force tending to spin the cone from the holder, and to positively retain the cone in the exact position required for proper winding from the cam traverse, the present improvement has been developed.

The improvement contemplates a cone holder provided with upper and lower tapered surfaces and a cutaway mid-section body having a pair of opposed spring finger means mounted thereon, which finger means are outwardly sprung against the inner wall of a cone in position for cone winding, thereby grasping and retaining the cone on the holder until it is fully wound, at which time the cone arm linearly moves the spindle with respect to the expander and retracts the spring finger means in an arcuate path to allow cone release and removal.

The principal object of the invention is to provide a novel apparatus for retaining the cone upon the holder in a more positive fashion than heretofore possible.

A further object of the invention is to provide a means of retaining a cone upon the holder which is self-contained and which requires no external assistance.

A still further object of the invention is a reduction in the complexity of the mechanism required to maintain the cone upon the holder in a proper position for the winding operation.

These and other objects will become more apparent from a reading of the following specification taken in conjunction with the drawings, in which.

Figure 1:
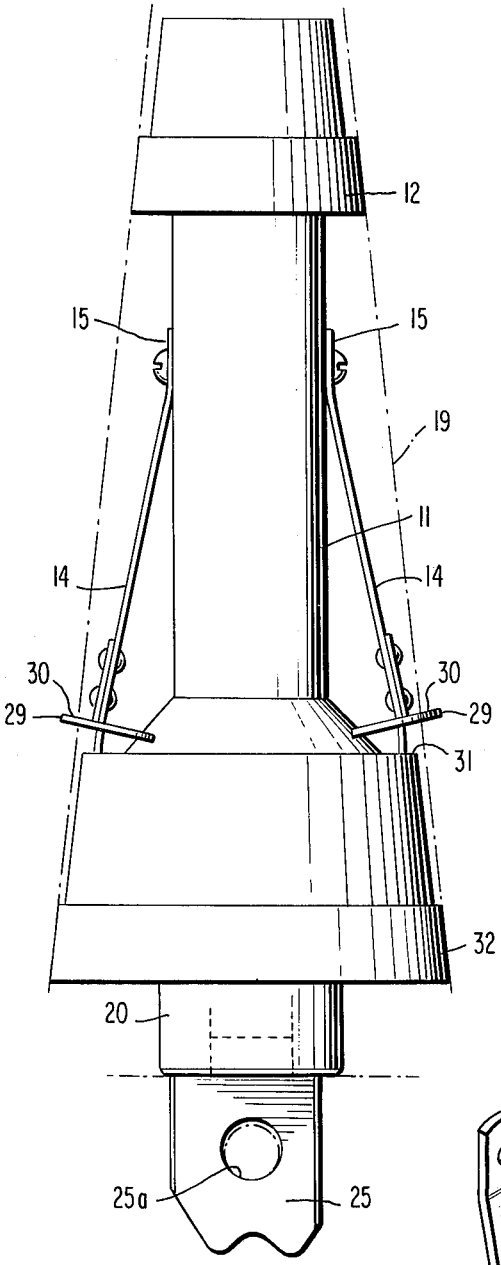
FIG. 1 is an elevational view of the cone holder.
Figure 2:
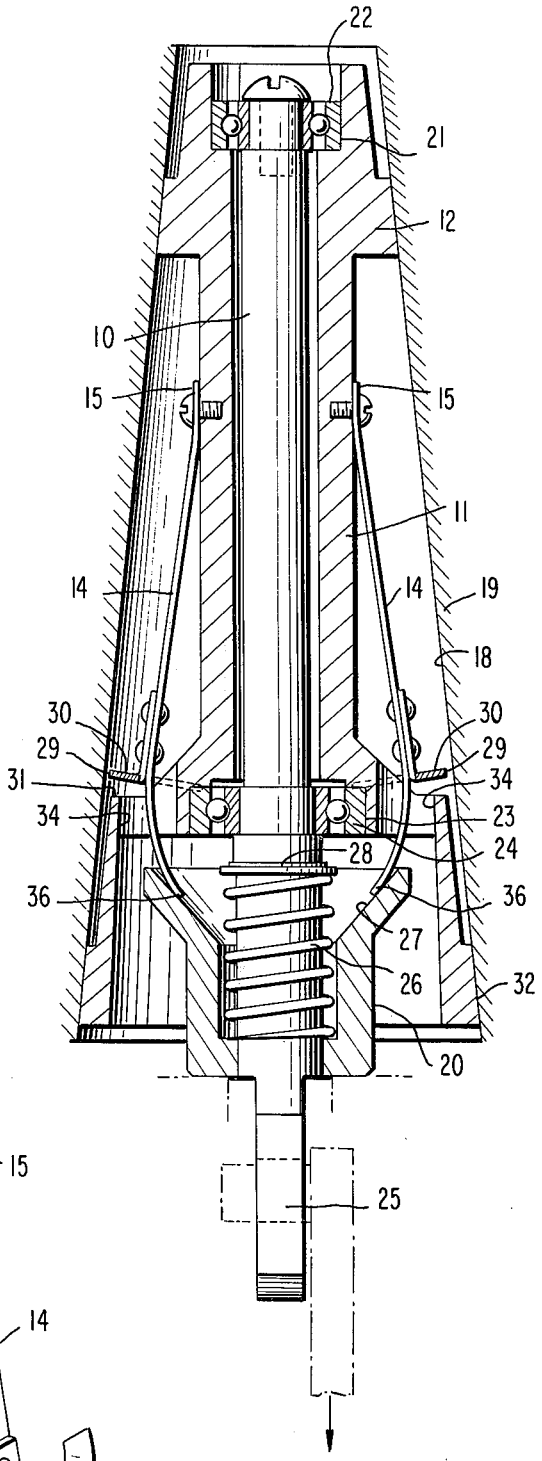
FIG. 2 is a partial elevation and cross-sectional view of the cone holder clearly showing the operative mechanism of the invention.
Figure 3:
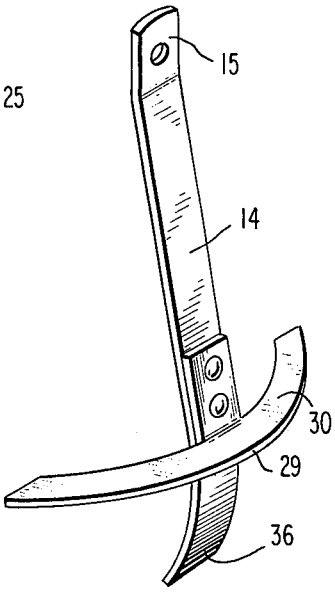
FIG. 3 is a perspective view of one of the two spring finger means prior to being mounted on the holder.

Referring now to FIG. 1, there is shown in this view a spindle means 10 on which is mounted a cone holder support means 12 having upper and lower tapered surfaces, as shown by interposition of upper and lower bearing means 22, 24, respectively, the races of each bearing being mounted in shoulders 21, 23, respectively, of the cone holder support means 12 allowing rotational movement of the cone holder support means 12 independent of spindle movement. To the body 11 of the cone holder support means there are secured the fixed extremities 15—15 of opposed spring finger means 14—14, which extend rearward toward a flared conical skirt member 32. These spring fingers protrude through means defining openings 34—34, in the frontal portion 31 of the flared skirt member 32, and circumscribe an arcuate form leading to the termini 36—36. Further, the spring finger means 14—14 are pivotal from their fixed extremities as shown at 15—15, so that the termini 36—36 inscribe a small arcuate path with respect to a first cone-engaging position and a second cone-releasing position.

Retention of a yarn winding cone or bobbin on the cone holder support means 12 is achieved by means of arcuate means 30 in the form of semi-curved blade members mounted in known fashion such as by riveting upon the spring fingers 14—14, adjacent their longitudinal extremities 36—36, in a normal relation to the fingers for contact with the inner wall area 18 of a cone 19 desired to be spooled. In the first and usual cone-engaging position the surface 29 of the arcuate means 30 make friction contact with the inner wall 18 of the cone member 19, thereby retaining the cone on the support means 12, as will now be more fully explained.

When it is desired, as when a spooling operation has been completed and the yarn has been wound to its full extent on the cone, the cone may be released from the support means for replenishment with a bare cone. This releasing operation requires that a spring finger actuating means 20, mounted on the spindle 10, be moved axially of the spindle by cone arm 25, against a resilient means 26 provided with a stop member 28, from a first non-spring finger contacting position, as shown in FIG. 1, into a second spring finger contacting position.

As mounted in the machine for which it is provided, the cone holder as an assembly is moved in an axial manner by a connecting rod (not shown) joined to cone arm 25 as at bore 25a. Further, the spring finger actuating means 20 is blocked by an appropriate member (in phantom line) so that on movement of spindle 10, the termini 36—36 of spring fingers 14—14, come into contact with the actuating means thereby retracting the fingers and releasing the cone for dispensing and replacement.

The rectilinear movement of actuating means 20 from its usual first position into the second operative position brings the outwardly flared inner walls 27 of actuating means 20 into contact with the arcuate termini 36—36 of spring fingers 14—14 convergently contracting them through an arcuate path to an opposed, closely spaced relation with respect to the spindle 10. This movement withdraws the arcuate blade means 30 from contact with the inner wall 18 of the cone, allowing the cone to be removed from the support means 12.

That which is claimed is:

1. In a yarn winder, the combination comprising:

a a spindle means;

b a cone holder support means for supporting a cone member, said cone holder support means including upper and lower recesses serving to support first and second roller bearing means and arranged for rotary movement on said spindle;

c two spring finger means, each said spring finger means having upper and lower extremities, said upper extremity fastened to and at diametrically opposed sides of said cone holder support means;

d. spring finger actuating means, each said lower extremity disposed on said spring finger actuating means for pivotal movement thereof upon actuation of said spring finger actuating means; and e blade means disposed on each said spring finger means having an arcuately shaped substantially flat outer surface in the direction of curvature of said cone member, each said blade means rigidly secured intermediate the ends thereof to its respective finger means, said flat surface adapted to engage and retain said cone member about one line of its inner periphery without deformation or penetration of said cone member.

2. An arrangement as claimed in claim 1, further comprising a resilient means positioned between said first bearing means and said spring finger actuating means, said first bearing means being positioned closer to said spring finger actuating means than said second bearing means.

3. An arrangement as claimed in claim 2, further comprising a stop member for said resilient means associated with said spindle beneath said first bearing means.

4. An arrangement as claimed in claim 3, wherein said stop member is locked to said spindle means and spaced from said first bearing means.

5. An arrangement as claimed in claim 1, wherein said cone holder support means includes a skirt member formed as an integral part thereof.

* * * * *